US008657473B2

(12) United States Patent
Esmailzadeh

(10) Patent No.: US 8,657,473 B2
(45) Date of Patent: Feb. 25, 2014

(54) FIRE BARRIER RECESSSED LIGHTING FIXTURE

(76) Inventor: Rouhallah Esmailzadeh, Los Angeles, CA (US)

( * ) Notice: Subject to any disclaimer, the term of this patent is extended or adjusted under 35 U.S.C. 154(b) by 57 days.

(21) Appl. No.: 13/507,794

(22) Filed: Jul. 30, 2012

(65) Prior Publication Data

US 2014/0029271 A1 Jan. 30, 2014

(51) Int. Cl.
*F21V 15/00* (2006.01)

(52) U.S. Cl.
USPC ..... 362/365; 362/364; 362/366; 362/362

(58) Field of Classification Search
USPC ..... 362/364, 365, 366, 362
See application file for complete search history.

(56) References Cited

U.S. PATENT DOCUMENTS

| | | | | |
|---|---|---|---|---|
| 4,122,203 | A | 10/1978 | Stahl | |
| 4,237,671 | A | 12/1980 | Munson | |
| 4,754,377 | A | 6/1988 | Wenman | |
| 5,662,413 | A | 9/1997 | Akiyama | |
| 6,105,334 | A | 8/2000 | Monson | |
| 6,357,891 | B1 | 3/2002 | Newbold et al. | |
| 6,838,618 | B2 | 1/2005 | Newbold et al. | |
| 7,114,294 | B2 | 10/2006 | Newbold et al. | |
| 7,208,677 | B2 | 4/2007 | Moselle | |
| 7,320,536 | B2 | 1/2008 | Petrakis et al. | |
| 7,503,145 | B2 | 3/2009 | Newbold et al. | |
| 7,651,238 | B2 | 1/2010 | O'Brien | |
| D624,688 | S | 9/2010 | Johnson | |
| 7,841,135 | B2 | 11/2010 | Newbold et al. | |
| 2004/0010990 | A1 | 1/2004 | Moselle | |
| 2005/0024856 | A1* | 2/2005 | Helenowski | 362/147 |
| 2006/0158873 | A1 | 7/2006 | Newbold et al. | |
| 2007/0268708 | A1 | 11/2007 | O'Brien | |
| 2008/0087492 | A1* | 4/2008 | Cox et al. | 181/150 |
| 2008/0170404 | A1 | 7/2008 | Steer et al. | |
| 2010/0014282 | A1 | 1/2010 | Danesh | |

* cited by examiner

*Primary Examiner* — Evan Dzierzynski
(74) *Attorney, Agent, or Firm* — Don Finkelstein

(57) ABSTRACT

A recessed lighting fixture having a fire resistant barrier thereon and the fire resistant barrier having an outer box enclosure and an inner box enclosure with an air gap therebetween and mounted on a mounting pan over a lamp housing a source of illumination such as a bulb therein and the mounting pan positionable adjacent an opening in a structure such as a wall, ceiling or floor having an aperture aligned with the lamp housing to let the illumination from the bulb pass therethrough.

18 Claims, 4 Drawing Sheets

FIRE BARRIER RECESSSED LIGHTING FIXTURE

BACKGROUND OF THE INVENTION

1. Field of the Invention

This invention relates to the recessed lighting fixture art and more particularly to a fire retarding recessed lighting fixture acting as a fire barrier for inhibiting the spread of a fire through the recessed lighting fixture into the structure in which the recessed lighting fixture is mounted.

2. Description of the Prior Art

Recessed lighting fixtures of the type that are mounted within ceilings, walls and floors of buildings including commercial, residential and industrial buildings have heretofore been utilized to provide light and provide a modern, smooth finish to the structure in which they are mounted thus avoiding the requirements for hanging chandeliers. The recessed lighting fixture is mounted in a space between the outer layer of the structure such as wall board, planking, and the like and the basic support members and connecting members of the structure. However, in the past the opening in the outer layer such as the dry wall of a ceiling, wall or the like has provided an opening therethrough through which a fire may spread into the interior of, for example, the ceiling or wall and thus spread the fire throughout the building. Even though a recessed lighting fixture of conventional, prior art design was installed in the ceiling or wall, the breach in the integrity of the wall or ceiling caused by making the opening in the drywall, planking, or the like, often let the fire progress through and around such prior art lighting fixtures.

One attempt that has heretofore been utilized to prevent the spread of fire through or around a recessed lighting fixture is the fabrication and installation of a box like structure having a top and four sides defining a cavity and fabricated. in situ by the installer from a fire resistant material such as the drywall. The box like structure was placed on the recessed lighting fixture mounting plate with the recessed lighting fixture in the cavity and the assembly of the fire box and recessed lighting fixture was then installed into the recessed lighting fixture space in the wall or ceiling. The use of such a box like structure to provide fire blocking or inhibiting through the recessed lighting fixture has been proven to be costly and time consuming.

In other prior art techniques for providing a fire barrier at a recessed lighting fixture the recessed lighting fixture to inhibit the heat from transferring through the light fixture to an area above the surface of recessed lighting fixture. The recessed lighting fixture was provided with an open bottom box like structure having a top wall and a four spaced apart side walls. The top wall and side walls were fabricated from a rigid material such as steel or aluminum and the top wall was connected to the side walls and spaced from the mounting pan to allow the installation of the recessed lighting fixture under the top wall and between the side walls. The side walls were attached to the mounting pan. A comparatively thick layer of insulating material was placed on the inside surface of the top wall and side walls of the box like structure or, alternatively, on the inside surface of some of the side walls and on the outside surface of the top wall and at least one of the side walls. Such a design for a thermal barrier recessed lighting fixture has not proven to be fully satisfactory since it requires the addition of a separate material, the insulating layer, not normally found in the inventory of recessed lighting fixture manufacturers.

In other fire resistant recessed lighting fixtures, an insulating layer of material was placed between the inside surface of the can and the lamp/reflector units. Such an installation did not, generally, provide the desired level of a barrier of fire through the recessed lighting fixture.

For many recessed lighting fixture manufacturers which are accustomed to manufacturing products of metal and adding glass and various electrical parts, the introduction of a totally different product, namely insulating materials, would require a large expenditure of capital. Many of the insulating products have health hazardous consequences in the cutting and manipulating thereof. As a consequence, the added cost to the manufacturer of utilizing such insulating materials must be passed on to the consumer by increased prices for such recessed lighting fixtures incorporating the insulating material.

Thus, there has long been a need for a recessed lighting fixture which can provide a barrier to fire through the recessed lighting fixture and which is free of separate insulating materials.

Accordingly, it is an object of the present invention to provide an improved recessed lighting fixture which may be installed in a ceiling, wall, floor or the like, adjacent an opening in the ceiling, wall or floor of a building and which provides a barrier to fire passing through the opening in the ceiling, wall or floor.

It is another object of the present invention to provide an improved recessed lighting fixture which may be installed in a ceiling, wall, floor or the like, adjacent an opening in the ceiling, wall or floor of a building and which provides a barrier to fire passing through the opening in the ceiling, wall or floor and which does not utilize natural or manufactured fire resistant materials as all or part of the fire barrier.

It is yet another object of the present invention to provide an improved recessed lighting fixture which may be installed in a ceiling, wall, floor or the like, adjacent an opening in the ceiling, wall or floor of a building and which provides a barrier to fire passing through the opening in the ceiling, wall or floor and which may be conveniently fabricated by the recessed lighting fixture manufacturer utilizing conventional recessed lighting fixture materials and components.

It is another object of the present invention to provide an improved recessed lighting fixture which may be installed in a ceiling, wall, floor or the like, adjacent an opening in the ceiling, wall or floor of a building and which provides a barrier to fire passing through the opening in the ceiling, wall or floor and which is comparatively easily installed.

SUMMARY OF THE INVENTION

The above and other objects of the present invention are achieved, in a preferred embodiment thereof, in a recessed lighting fixture of the type adapted to be placed inside a wall, ceiling or floor and direct light outwardly therefrom through an opening in the wall, ceiling or floor. The recessed lighting fixture has a mounting pan mounted on the inside surface of the wall ceiling or floor and the mounting pan has an aperture therethrough aligned with the opening in the wall, ceiling or floor. A lamp housing, or can as it is generally referred to in the recessed lighting fixture art, is mounted on the mounting pan and positioned over and surrounding the aperture in the mounting pan. The can or lamp housing is generally a dome shaped member having a central cavity defined by a can top and can side walls. which may be conical, cylindrical or any other desired configuration for particular applications. An electrical socket and a lamp bulb are inside the cavity in the can and light is directed from the lamp bulb and as may be reflected from the interior surface of the can through the aperture in the mounting pan and through the opening in the wall, ceiling or floor to regions external thereof.

A fire resistant wire junction box is mounted on the inside surface of the mounting pan and is adapted to receive an electrical power cord and has an electrical conduit extending from the fire proof junction box to the socket in the can to provide the electrical power to energize the lamp.

An outer enclosure is mounted on the mounting pan and surrounding the can or lamp housing and is spaced a first preselected distance from the can or lamp housing. The outer enclosure has an outer enclosure top wall and outer enclosure side walls. At least some of the outer enclosure side walls have outer enclosure lower flange like surfaces engaging the mounting pan to support the outer enclosure thereon. The outer enclosure top wall and the outer enclosure side walls define a volume that is closed at the top and open downwardly towards the mounting pan.

An inner enclosure is also mounted on the mounting pan intermediate the lamp housing and the outer enclosure and is spaced a second preselected distance from the outer enclosure to define an air gap between the outer enclosure and the inner enclosure. In the preferred embodiments of the present invention the air gap contains only ambient air and is free of natural thermal insulating materials such as asbestos or the like as well as being free of man made thermal insulating materials such as fiber glass or the like. The inner enclosure is spaced a third preselected distance from the can or lamp housing. The inner enclosure has an inner enclosure top wall and inner enclosure side walls define a volume that is closed at the top and open downwardly towards the mounting pan. At least some of the inner enclosure side walls have inner enclosure lower flange like surfaces for supporting the inner enclosure on the mounting pan. The outer enclosure and the inner enclosure as mounted on the mounting pan as above described to provide the air gap act as a fire barrier to prevent fire from passing from regions external the wall, ceiling or floor, through the opening in the wall, ceiling or floor, through the mounting pan, past the can or lamp housing to regions inside the wall, ceiling or floor.

A trim ring may be provided on the external surface of the wall, ceiling or floor around the opening therein and may be preferably attached to, or engaging the lower edges of the lamp housing or. can.

The outer enclosure may have a planar top wall and planar side walls. The inner enclosure may have a planar top wall spaced from inner surface of the outer enclosure planar top wall and planar side walls that are spaced from the inside surfaces of the outer enclosure planar side walls.

In other preferred embodiments of the present invention, the outer enclosure and/or the inner enclosure may have a dome shaped top wall and conical or cylindrical side walls.

BRIEF DESCRIPTION OF THE DRAWING

The above and other embodiments of the present invention my be more fully understood from the following detailed description taken together with the accompanying drawing wherein similar reference characters refer to similar elements throughout and in which.

DESCRIPTION OF THE PREFERRED EMBODIMENTS

Figure 1:
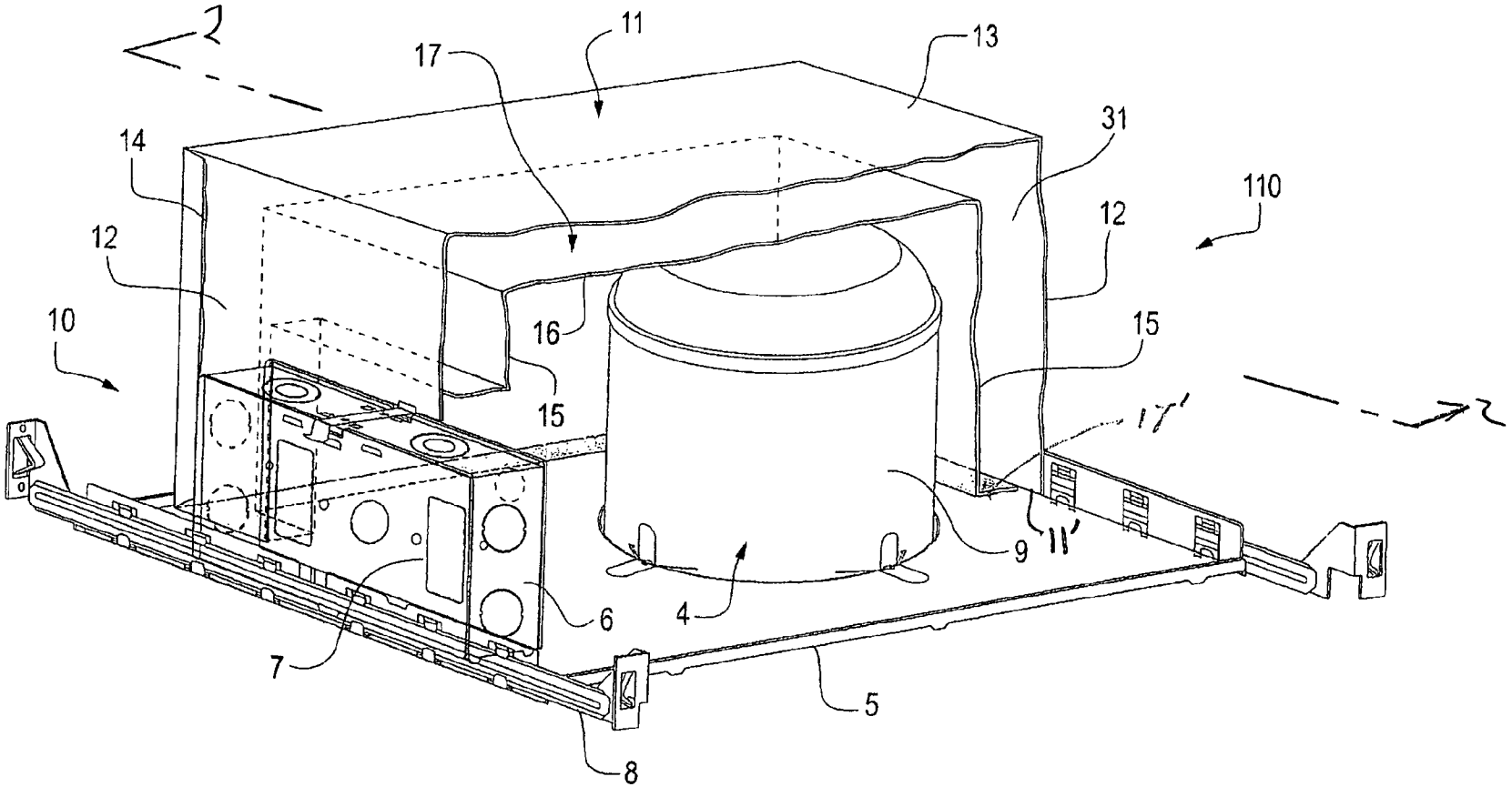
FIG. 1 is a perspective view partially in section of a preferred embodiment of the present invention.
Figure 2:
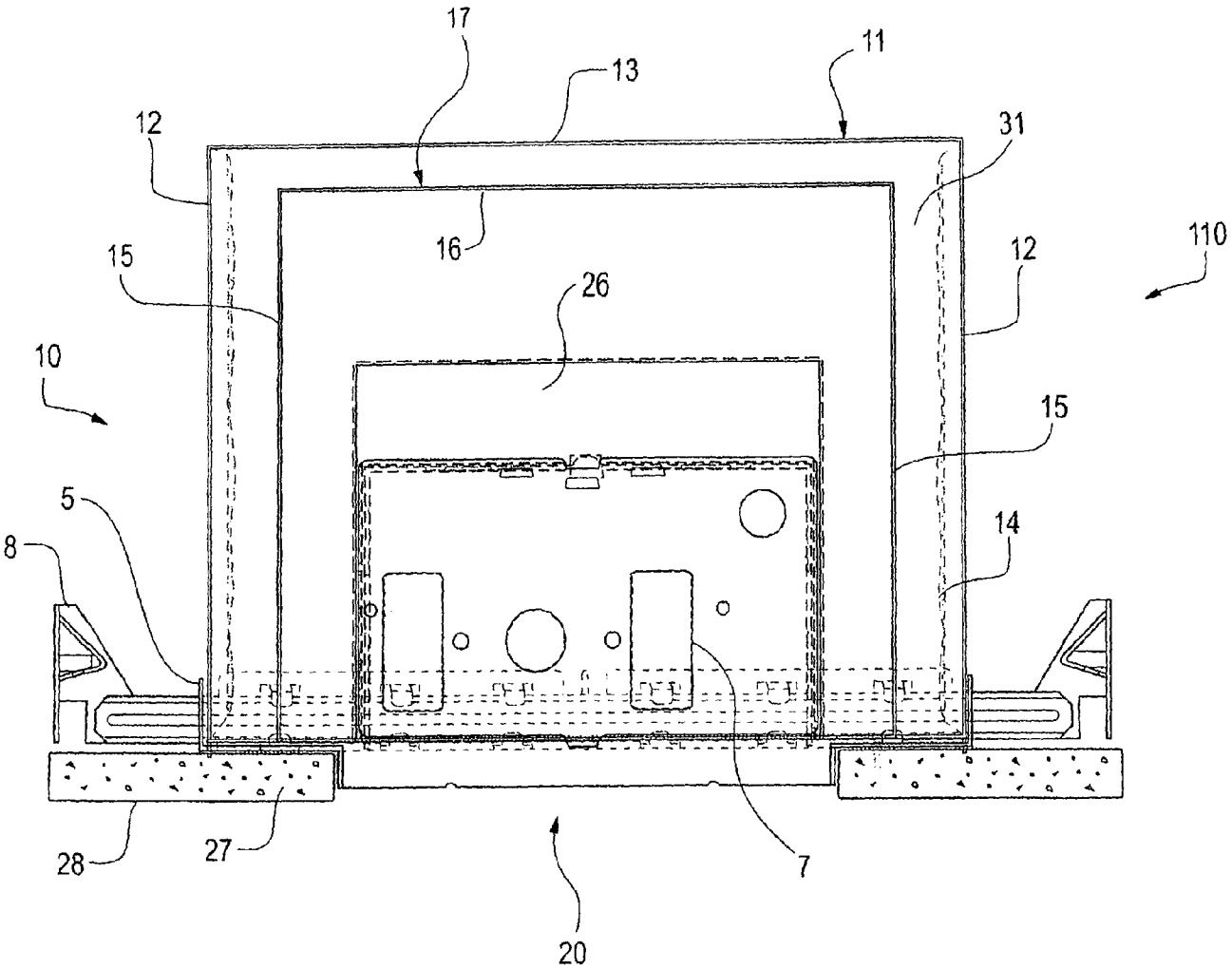
FIG. 2 is a sectional view along the line 2-2 of FIG. 1.

Referring now to the drawing there is shown in FIGS. 1 and 2 an embodiment 110 of a fire barrier recessed lighting fixture according to the principles of the present invention. In FIG. 1 which is a perspective and partial sectional view in which the electrical connections have been omitted for clarity, there is shown a lamp housing 4, often called a "can" in which a source of illumination such as an incandescent bulb, a fluorescent bulb, a compact fluorescent or the like (not shown in FIGS. 1 and 2) is contained. The source of illumination is powered by electrical energy and is positioned in the housing 4 to direct illumination downwardly through an aperture 20 (FIG. 2) in a mounting pan 5 upon which the housing 4 is mounted. and through a barrier 27 having an outer surface 28 so at to direct the illumination therethrough. The aperture 30 and the opening in the barrier 27 may be circular or any other desired shape. The entire fixture of embodiment 110 is adapted to be a recessed fixture in a ceiling, wall, floor or other barrier as shown at 27 in FIG. 2. The space indicated at 26 provides access from inside of the inner box 17 to the to the junction box 6.

A fire resistant wire junction box 6 having a fire resistant junction box plate 7 is provided to receive the electrical energy and transmit the electrical energy to the source of illumination in the housing 4 and the details of the electrical transmission are omitted from FIGS. 1 and 2 for clarity. The housing 4 has a cylindrical shape as indicted at 9, however any other desired geometrical shape may be utilized as desired for particular applications. The fixture of embodiment 110 has hanger bar brackets 8 for mounting on the structure 27.

A fire barrier or box generally indicated at 10 is comprised of a two layer structure having an outer fire resistant barrier or box enclosure 11 with four side walls 12 and a top wall 13. The four side walls 12 and top wall 13 may be unitarily formed of sheet metal or may be comprised of separate components joined together by welding as indicated at 14, by metal screws or the like and the outer box 11 is secured to the mounting pan 5 as indicated at 11'.

The fire barrier or box 11 also has an inner box enclosure 17 positioned inside the outer box 11 and spaced therefrom by an air space 31 therebetween. The inner box 17 has four side walls 15 and a top wall 16. The four side walls 15 and top wall 16 may be unitarily formed of sheet metal or may be comprised of separate components joined together by welding, by metal screws or the like. The inner box 17 may be fixed to the mounting pan 5 by flanges as indicated at 17'. the flanges may be directed outwardly as shown on FIG. 1 or inwardly as may be appropriate in various applications. The outer box 11 and inner box 17 are preferably formed of aluminum or steel. The outer box 11 and inner box 17 are positioned over the housing 4 to provide a fire barrier thereover.

The top wall 13 of the outer enclosure 11 may be of a geometric shape other than planar such as dome like or otherwise and, similarly, the side walls 12 of the outer enclosure 11 may be other than cylindrical such as conical or other wise. Similarly, he top wall 16 of the inner enclosure 17 may be of a geometric shape other than planar such as dome like or otherwise and, similarly, the side walls 15 of the inner enclosure 17 may be other than cylindrical such as conical or other wise. These variations on the geometric shapes of the inner enclosures and outer enclosures may be utilized in all the embodiments of the present invention as described below.

Figure 3:
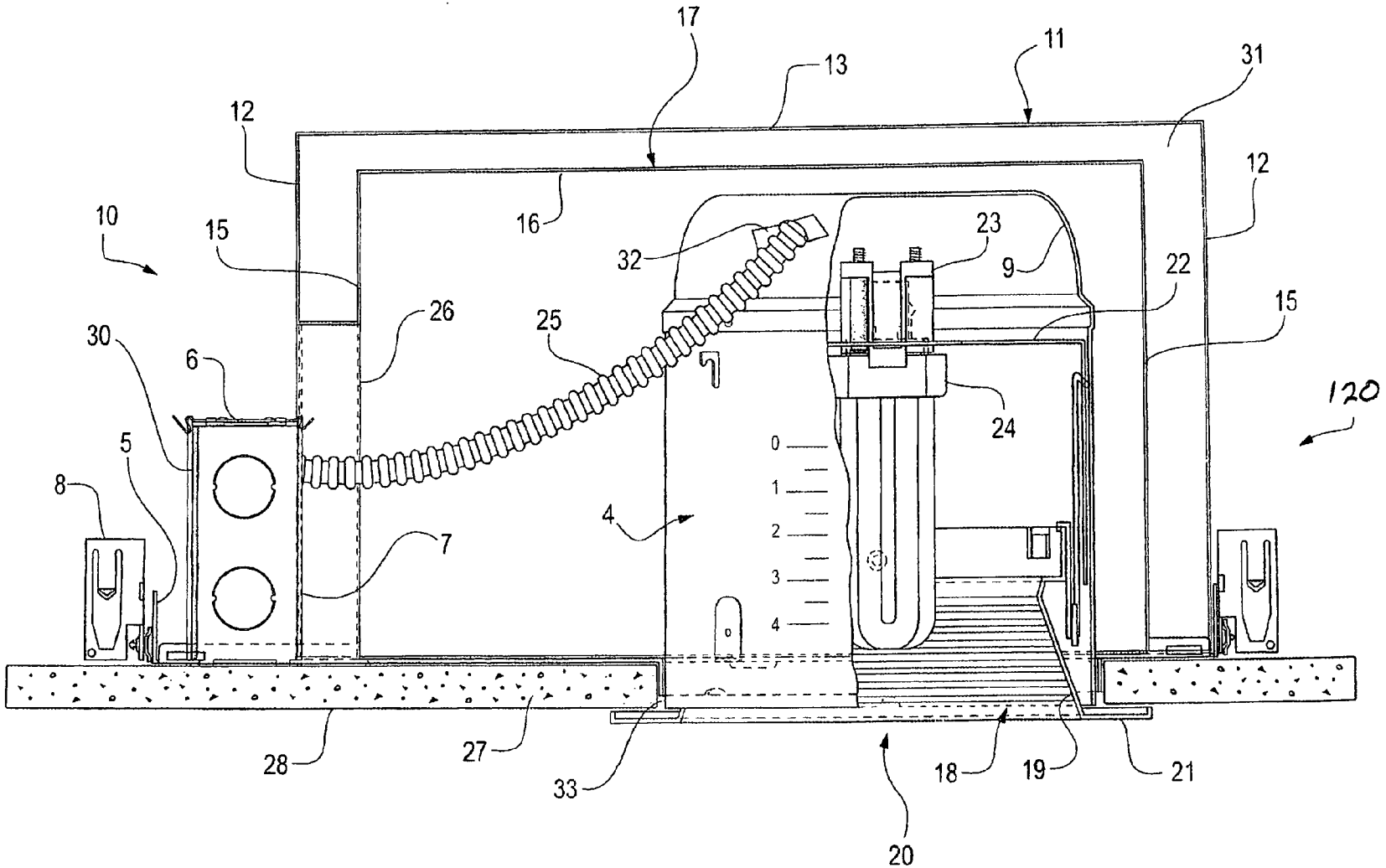
FIG. 3 is a sectional view of another embodiment of the present invention.

FIG. 3 illustrates another embodiment generally indicated t 120 of a fire barrier recessed lighting fixture according to the principles of the present invention. The embodiment 120 is generally similar to the embodiment 110 and has a housing 4 surrounded by a double walled fire barrier 10 comprised of an outer box enclosure 11 and a spaced apart inner box enclosure 17 with an air gap 31 therebetween. The embodiment 120 has a cylindrical opening 20 in the pan 5 positioned above the opening 33 in the structure 27 extending through the outer surface 28 thereof. A trim 18 is provided to fit into the housing 4 and has an outer surface 19 that is in close proximity to opening 33 after installation of the embodiment 120. The trim 18 outer surface 19 is configured to substantially enclose opening 33. The trim 18 as shown on FIG. 3 has a conical shape though other shapes may be utilized as desired for particular applications. The trim 18 has an integral trim ring or flange 21 which is adapted to extend over any gap in the opening 33.

FIG. 3 shows the electrical connection between the junction box 6, which preferably has a fire resistant thermoplastic pad 30 and an illumination source 24 in the housing 4. As shown, there is provided a conduit cable 25 extending from the junction box 6 and which is connected to a source of electrical energy (not shown) at the junction box 6 to a conventional conduit fitting 32 at the housing 4. The housing 4 includes a bracket 22 which has one or more lamp sockets 23. The lamp socket 23 may be positioned at any desired geometrical relations ship to the opening 20 and is adapted to receive a source of illumination 24. In FIG. 3, the source of illumination is positioned generally perpendicular to the surface 28.

Figure 4:
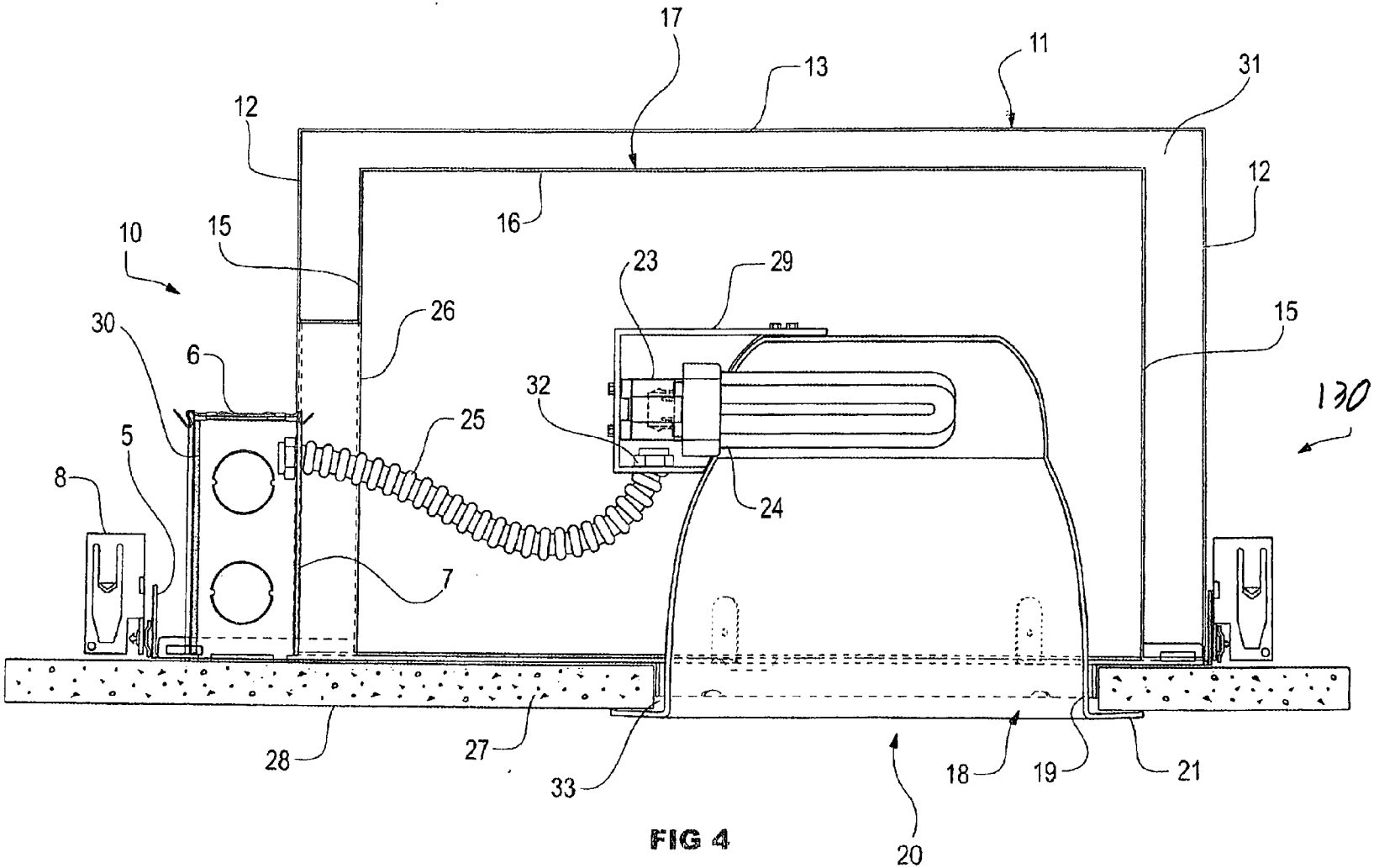
FIG. 4 is a sectional view of another embodiment of the present invention.

FIG. 4 illustrates another embodiment 130 of a fire barrier recessed lighting fixture according to the principles of the present invention and is generally similar to the embodiment 120 of FIG. 3. In the embodiment 130 the trim 18 includes a bracket 29 at the top of the thereof having one or more sockets 23 for receiving a source of illumination 24 and the electrical connection by the cable 25 from the junction box 6. As shown on FIG. 4, the source of illumination 24 is parallel to the surface 28. In the embodiment 130, the trim 18 comprises both the trim and also acts as the housing for the source of illumination 24 thus combining the functions of the housing 6 and the trim 18 into a single structure.

In some embodiments of the present invention it may be desirable to place one or more layers of insulating material in various portions of the structure show such as in the space 31 between the outer box enclosure 11 and inner box enclosure 17, or other locations as may be desired.

Although specific embodiments of the present invention have been described above with reference to the various Figures of the drawing, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

What is claimed is:

1. A fire barrier recessed lighting fixture arrangement comprising, in combination:

a mounting pan;

a lamp housing mounted on said mounting pan and having internal walls defining a lamp accepting cavity and lower edges;

an outer enclosure mounted on said mounting pan and surrounding said lamp housing and spaced a first preselected distance therefrom and said outer enclosure have having an outer enclosure top wall and outer enclosure side walls, at least some of said outer enclosure side walls having outer enclosure lower surfaces engaging said mounting pan to support said outer enclosure thereon;

an inner enclosure mounted on said mounting pan intermediate said lamp housing and said outer enclosure and spaced a second preselected distance from said outer enclosure to define an air gap between said outer enclosure and said inner enclosure, and said inner enclosure spaced a third preselected distance from said lamp housing, and said inner enclosure having an inner enclosure top wall and inner enclosure side walls, and at least some of said inner enclosure side walls having inner enclosure lower flange like surfaces for supporting said inner enclosure on said mounting pan;

whereby said outer enclosure and said inner enclosure as mounted on said mounting pan prevent fire prevent fire from passing from said mounting pan to regions external said outer enclosure.

2. The arrangement defined in claim 1 wherein:

said top wall of said outer enclosure is of a geometric shape other than planar; and, said top wall of said inner enclosure is of a geometric shape other than planar.

3. The arrangement defined in claim 2 and further comprising:

thermal insulating material in said air gap space between said outer enclosure and said inner enclosure.

4. The arrangement defined in claim 1 wherein:

said inner enclosure top wall is planar;

said inner enclosure side walls are planar.

5. The arrangement defined in claim 1 wherein:

said outer enclosure top wall is dome like;

said outer enclosure side walls are conical.

6. The arrangement defined in claim 5 and further comprising:

a trim ring adjacent said lower edges of said housing.

7. The arrangement defined in claim 1 wherein:

said inner enclosure top wall is dome like;

said inner enclosure side walls are conical.

8. The arrangement defined in claim 1 wherein:

said outer enclosure is fabricated from steel.

9. The arrangement defined in claim 8 wherein:

said inner enclosure is fabricated from steel.

10. The arrangement defined in claim 1 wherein:

said inner enclosure is fabricated from steel.

11. A fire barrier recessed lighting fixture of the type adapted to be placed within a wall, ceiling or floor of a building over an opening in the wall, ceiling or floor to allow light emitted from the recessed lighting fixture to pass through the opening, comprising, in combination:

a mounting pan in the wall, ceiling or floor having pan walls defining a pan opening aligned with the opening in the wall, ceiling or floor;

a lamp housing mounted on said mounting pan and having internal walls defining a lamp accepting cavity and aligned with said pan opening and said lamp housing directing light emitted therefrom through said pan opening and through the opening in the wall, ceiling or floor and having a lower edge in regions adjacent the wall, ceiling or floor;

an outer enclosure mounted on said mounting pan and surrounding said lamp housing and spaced a first preselected distance therefrom, and spaced from said pan opening in said mounting pan, and said outer enclosure have having an outer enclosure top wall spaced from said mounting pan and outer enclosure side walls, at least some of said outer enclosure side walls having outer enclosure lower edge surfaces engaging said mounting pan to support said outer enclosure thereon;

an inner enclosure mounted on said mounting pan intermediate said lamp housing and said outer enclosure and spaced a second preselected distance from said outer enclosure and spaced a third preselected distance from said lamp housing to define an air gap between said outer enclosure and said inner enclosure, and said inner enclosure having an inner enclosure top wall spaced from said mounting pan and inner enclosure side walls, and at least some of said inner enclosure side walls having inner enclosure lower flange like surfaces for supporting said inner enclosure on said mounting pan;

an annular trim adjacent the wall, ceiling or floor and surrounding the opening in the wall, ceiling or floor, and having walls defining a trim opening to allow the passage of light emitted from the recessed lighting fixture to pass therethrough;

a junction box mounted on said mounting pan in regions external said outer enclosure and spaced from said lamp housing, for receiving a power cord providing electricity and has a whereby said outer enclosure and said inner enclosure as mounted on said mounting pan prevent fire prevent fire from passing through the opening in the wall, ceiling or floor and through said pan opening in said mounting pan and through said trim to regions external said outer enclosure in the wall, ceiling or floor.

12. The arrangement defined in claim 11 wherein:

said trim further comprises the lamp housing.

13. The arrangement defined in claim 12 wherein:

said trim further comprises an integral trim ring at the lower surface of the trim.

14. The arrangement defined in claim 13 wherein:

said outer enclosure and said inner enclosure are fabricated from steel.

15. The arrangement defined in claim 13 wherein:

said outer enclosure and said inner enclosure are fabricated from aluminum.

16. The arrangement defined in claim 12 wherein:

said top wall of said outer enclosure is of a geometric shape other than planar;

said top wall of said inner enclosure is of a geometric shape other than planar said side walls of said outer enclosure are other than cylindrical; and, said side walls of said inner enclosure are other than cylindrical.

17. The arrangement defined in claim 16 wherein:

said air gap has preselected thermal insulation therein.

18. The arrangement defined in claim 11 wherein:

said air gap has preselected thermal insulation therein.

* * * * *